US007379032B2

(12) United States Patent
Ohira et al.

(10) Patent No.: US 7,379,032 B2
(45) Date of Patent: May 27, 2008

(54) PLASMA DISPLAY DEVICE

(75) Inventors: Koji Ohira, Kawasaki (JP); Yoshimi Kawanami, Kawasaki (JP); Nobuyuki Takahashi, Kawasaki (JP); Masahiro Sawa, Kawasaki (JP); Hiroyuki Nakahara, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 691 days.

(21) Appl. No.: 10/876,868

(22) Filed: Jun. 28, 2004

(65) Prior Publication Data

US 2004/0263435 A1 Dec. 30, 2004

(30) Foreign Application Priority Data

Jun. 30, 2003 (JP) ..... 2003-188506

(51) Int. Cl.
*G09G 3/28* (2006.01)

(52) U.S. Cl. ..... 345/60

(58) Field of Classification Search ..... 345/60
See application file for complete search history.

(56) References Cited

U.S. PATENT DOCUMENTS 4,728,864 A * 3/1988 Dick ..... 315/169.3
5,444,335 A * 8/1995 Matsumoto et al. ..... 315/246
5,852,347 A * 12/1998 Marcotte ..... 315/169.4
5,998,935 A * 12/1999 Marcotte ..... 315/169.4
6,037,916 A * 3/2000 Amemiya ..... 345/60
6,084,558 A * 7/2000 Setoguchi et al. ..... 345/60
6,265,826 B1 * 7/2001 Miyazaki ..... 313/586
6,411,035 B1 * 6/2002 Marcotte ..... 313/585
6,489,722 B1 * 12/2002 Yoshida et al. ..... 313/582
6,498,430 B1 * 12/2002 Sakai et al. ..... 313/582
6,498,594 B1 * 12/2002 Nunomura ..... 345/60

(Continued)

FOREIGN PATENT DOCUMENTS

EP 1 030 340 8/2000

(Continued)

OTHER PUBLICATIONS

Y. Tanaka et al., "A New Progressive Driving Scheme for a PDP with 'Castle' Structure," Asia Display, Dec. 2001, pp. 869-872.

(Continued)

*Primary Examiner*—Amare Mengistu
*Assistant Examiner*—Eli M Sheets
(74) *Attorney, Agent, or Firm*—Staas & Halsey LLP

(57) ABSTRACT

A plasma display device is provided that can realize a stable progressive display using a plasma display panel that has a shared type arrangement form of display electrodes. A plasma display panel structure including display electrodes having a shape that has little variation of electrode area between cells and a driving sequence are combined in which the addressing step is divided into the first half and the second half. One of the first half addressing and the second half addressing is performed for a row on which the first display electrode is arranged that has an odd arrangement order when noting only the first display electrodes that are not used for row selection, and the other of the first half addressing and the second half addressing is performed for a row on which the first display electrode is arranged that has an even arrangement order.

6 Claims, 10 Drawing Sheets

U.S. PATENT DOCUMENTS

| | | | | |
|---|---|---|---|---|
| 6,603,263 | B1 * | 8/2003 | Hashimoto et al. | 313/584 |
| 6,674,238 | B2 * | 1/2004 | Otani et al. | 313/587 |
| 6,856,305 | B2 * | 2/2005 | Nagano | 345/60 |
| 7,205,963 | B2 * | 4/2007 | Amatsuchi | 345/67 |
| 7,230,379 | B2 * | 6/2007 | Kwon et al. | 313/583 |
| 7,233,107 | B2 * | 6/2007 | Sawa et al. | 313/582 |
| 2001/0005189 | A1 * | 6/2001 | Numomura | 345/60 |
| 2002/0039086 | A1 * | 4/2002 | Hirakawa et al. | 345/60 |
| 2002/0047519 | A1 * | 4/2002 | Kunii et al. | 313/584 |
| 2002/0063524 | A1 * | 5/2002 | Nakamura et al. | 313/582 |
| 2002/0105485 | A1 * | 8/2002 | Shiizaki et al. | 345/60 |
| 2003/0001501 | A1 * | 1/2003 | Amemiya | 313/582 |

FOREIGN PATENT DOCUMENTS

| | | |
|---|---|---|
| EP | 1 052 670 | 11/2000 |
| EP | 1 271 460 | 1/2003 |
| FR | 2 830 679 | 4/2003 |
| JP | 8-315735 | 11/1996 |
| JP | 2000-113828 | 4/2000 |
| JP | 2003-5699 | 1/2003 |
| WO | WO 02/054439 | 7/2002 |

OTHER PUBLICATIONS

Y. Sato et al., "35:1 *Invited Paper*: A 50-in. Diagonal Plasma Display Panel with High Luminous Efficiency and High Display Quality," SID 02 Digest, May 2002, pp. 1060-1063.

Hirakawa, H., et al., "An Advanced Progressive Drivin Method for PDP with Horizontal Barrier Ribs and Common Electrodes."

Jae-Young Lee, et al., "A Study on the New Shaped Align-Free Sustain Electrodes Showing High Luminous Efficiency in AC PDPs", IDWOO (Dec. 2000).

KIPO Official Communication issued in priority Korean Counterpart Application No. 10-2004-0022852.

European Search Report, mailed Jun. 13, 2007 and issued in corresponding European Patent Application No. 04253861.1-2208.

* cited by examiner

PLASMA DISPLAY DEVICE

BACKGROUND OF THE INVENTION

1. Field of the Invention

The present invention relates to a plasma display device including a plasma display panel and a drive unit thereof.

An image display in a progressive form is superior to an image display in an interlace form from a viewpoint of luminance. Improvements of a plasma display device have been proceeding so as to realize an image display of a high resolution in a stable progressive form.

2. Description of the Prior Art

A surface discharge format is adopted for an AC type plasma display panel for a color display. Here, the surface discharge format has a structure in which display electrodes that become anodes and cathodes in display discharge for determining light emission quantity of cells are arranged on a front or back substrate in parallel, and address electrodes are arranged so as to cross the display electrode pairs.

There are two types of arrangement forms of the display electrodes in the surface discharge format. For convenience, one of the types is referred to as an individual type, and the other is referred to as a shared type. The individual type has a structure in which a pair of display electrodes is arranged for each row of a matrix display. The total number of display electrodes is twice the number of rows. The individual type can realize the progressive display by relatively simple driving sequence because each row can be controlled independently of other rows. However, an electrode gap between neighboring rows (that is called an opposite slit) becomes a non-light emission area, so a utilization factor of a screen is small. The shared type has a structure in which display electrodes whose number is the number of rows plus one are arranged at a constant pitch. In the shared type, neighboring display electrodes constitute a pair of electrodes for surface discharge, and all the display electrode gaps become surface discharge gaps. The shared type is superior to the individual type from the viewpoints of a vertical resolution (the number of rows) and the utilization factor of a screen. In either the individual type or the shared type, display electrodes making pairs are arranged in parallel, so it is necessary to provide a partition (a discharge barrier) for preventing discharge interference between cells arranged along the display electrode at least.

As a pattern of the partition, there are a stripe pattern by which a discharge space is divided into columns of the matrix display and a mesh pattern by which a discharge space is divided into columns and rows (i.e., into cells).

Conventionally, a plasma display panel having the stripe pattern partition and the shared type display electrode is driven by an interlace drive sequence, in which odd rows and even rows are lighted alternately. This driving sequence is disclosed in Japanese unexamined patent publication No. 9-160525. In addition, a variation of a shape of a display electrode in this type plasma display panel is disclosed in Japanese unexamined patent publication No. 2000-113828. In FIG. 3 of this publication a display electrode (a main electrode) that is patterned in T-shape for each cell is described, while in FIG. 11 of this publication a display electrode whose part for one row has a ladder-like shape is described. This publication also describes an effect of a band-like shape of the electrode that is cut off partially, which is that spreading of discharge in the column direction is suppressed, and that the maximum value of discharge current is decreased.

On the other hand, Japanese unexamined patent publication No. 2003-5699 describes a driving sequence for realizing a progressive form display by using a plasma display panel that has the shared type display electrodes and the mesh pattern partition that can suppress the discharge interference between rows. According to this driving sequence, rows are divided into two groups in accordance with a specific rule, addressing is performed for each group, and a reset step including charge adjustment is inserted between addressing for one group and addressing for the other group.

The progressive display according to the driving sequence described in the above-mentioned Japanese unexamined patent publication No. 2003-5699 requires a complicated control of wall charge, so it is necessary to decrease a variation of an operational condition among cells in the plasma display panel as much as possible. The variation of an operational condition causes a lighting error, which may make a display unstable. More specifically, there is a cell in which an area of the display electrode is smaller than a design value because of a misregistration of substrates that constitute a panel enclosure, a variation of a cell size depending on the partition, or the like. In such a cell, forming of charge for generating address discharge will occur insufficiently, so that a discharge start voltage for the address discharge will be higher than in other cells. In this case, the address discharge may be failed at high probability. On the contrary, a cell in which the area of the display electrode is larger than the design value will form excessive charge by the address discharge, so discharge may be generated in error in high probability.

In particular, if the plasma display panel has a larger screen and higher definition, the variation of cells becomes conspicuous, so that a stable progressive display becomes difficult to realize.

SUMMARY OF THE INVENTION

An object of the present invention is to realize a stable progressive display by using a plasma display panel that has a shared type arrangement of display electrodes.

According to the present invention, a plasma display panel structure that has display electrodes having a shape in which variation of an electrode area between cells is little and a known driving sequence are combined.

A plasma display device according to the present invention includes an AC type plasma display panel and a drive unit for driving the plasma display panel. The plasma display panel includes a screen that is made up of cells arranged in a matrix of rows and columns, a discharge barrier that is made up of vertical walls for dividing the screen into columns and horizontal walls for dividing the screen into rows, a plurality of first display electrodes that is arranged as row electrodes in the screen, a plurality of second display electrodes that is arranged so that the plural first and second display electrodes are arranged alternately and structure row electrode arrays in which neighboring rows share one row electrode, and address electrodes that are arranged as column electrodes in the screen. Each of the second display electrodes has a width that is larger than the horizontal wall and is constant over the entire length of the row, and has a band-like shape with plural holes that are arranged at a constant pitch along the horizontal wall at both sides of a portion overlapping with the horizontal wall. The drive unit includes a first driver that changes potential of the first display electrodes, a second driver that changes the potential of the second display electrodes, a third driver that changes the potential of the address electrodes, and a controller for controlling operations of the first driver, the second driver and the third driver. A driving sequence defining a control by the controller includes, (A) addressing for making wall voltage of all cells correspond to display data, being divided into the first half addressing and the second half addressing, (B) performing charge adjustment between the first half addressing and the second half addressing, (C) generating display discharge plural times corresponding to luminance to be displayed in all cells to be energized after the second half addressing, and (D) performing one of the first half addressing and the second half addressing for a row on which the first display electrode is arranged that has an odd arrangement order when noting only the first display electrodes and performing the other of the first half addressing and the second half addressing for a row on which the first display electrode is arranged that has an even arrangement order.

DESCRIPTION OF THE PREFERRED EMBODIMENTS

Hereinafter, the present invention will be explained more in detail with reference to embodiments and drawings.

Brief Description of a Device

Figure 1:
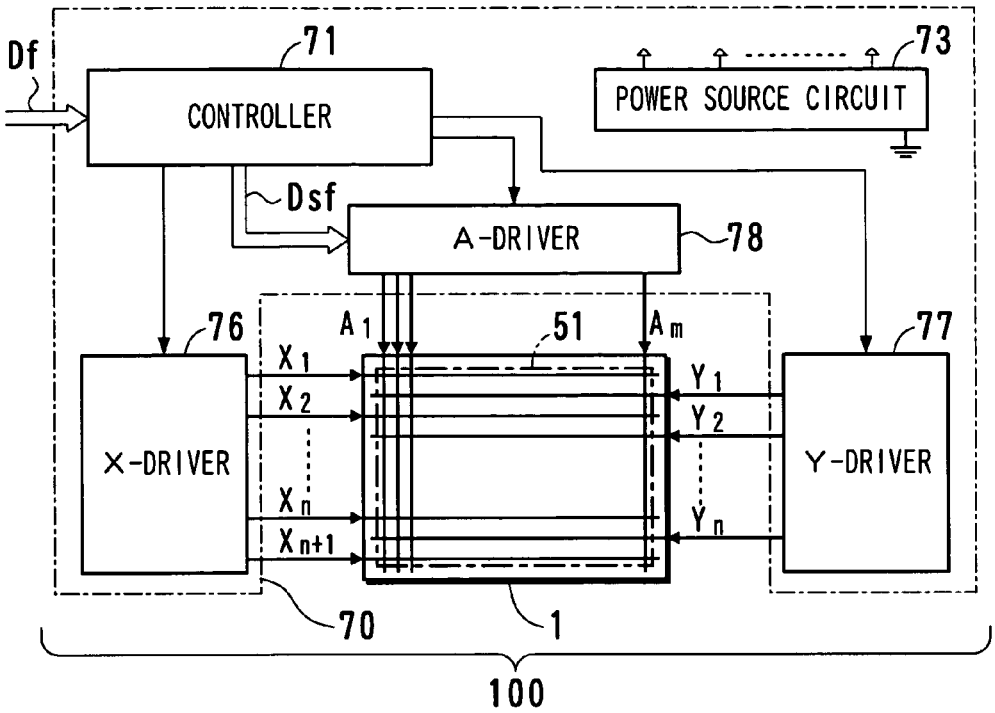
FIG. 1 is a structural diagram of a plasma display device.

FIG. 1 is a structural diagram of a plasma display device. The plasma display device 100 includes an AC type plasma display panel (PDP) 1 having a plurality of cells that constitute rows and columns of a matrix display, and a drive unit 70 for controlling light emission of the cells.

The plasma display panel 1 has a screen 51 in which (n+1) first display electrodes X and n second display electrodes Y are arranged alternately as row electrodes so as to constitute electrode pairs for generating display discharge of a surface discharge format, and address electrodes A are arranged as column electrodes so as to cross the display electrodes X and Y. The display electrodes X and Y extend in the horizontal direction, while the address electrodes A extend in the vertical direction. The total number (2n+1) of display electrodes X and Y is the number 2*n* of cells in one column plus one, and the total number m of address electrodes A is the same as the number of columns. In FIG. 1, suffixes of reference letters of the display electrodes X and Y and the address electrode A indicate arrangement orders.

Structure of the Drive Unit

The drive unit 70 includes a controller 71 in charge of drive control, a power source circuit 73 for supplying drive power, an X-driver 76 (a first driver) that changes potential of the display electrodes X, a Y-driver 77 (a second driver) that changes potential of the display electrodes Y and an A-driver 78 (a third driver) that changes potential of the address electrodes A. The Y-driver 77 includes a scan circuit that enables individual potential control for each of the n display electrodes Y.

The drive unit 70 is supplied with frame data Df that indicate luminance levels of R, G and B colors together with various synchronizing signals from an image output device such as a TV tuner or a computer. The frame data Df is stored in a frame memory of the controller 71 temporarily. The controller 71 converts the frame data Df into sub field data Dsf for a gradation display and sends the data to the A-driver 78 by serial transmission. The sub field data Dsf are display data in which one bit corresponds to one cell, and a value of each bit indicates whether or not a corresponding cell in one sub field is lighted, more exactly whether or not address discharge is necessary.

Brief Description of a Cell Structure

Figure 2:
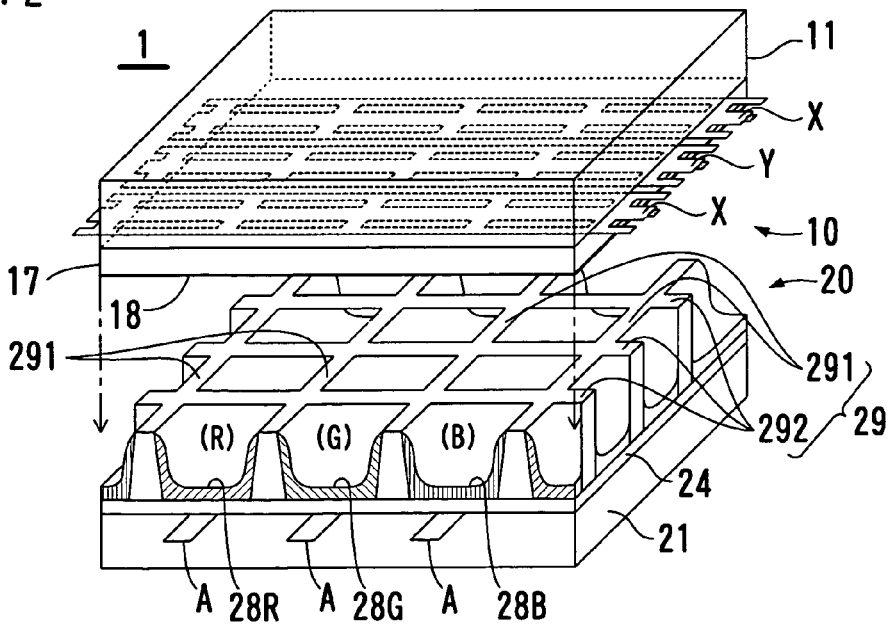
FIG. 2 is a diagram showing a cell structure of a plasma display panel.

FIG. 2 shows a cell structure of the plasma display panel 1. In FIG. 2, a portion corresponding to 3×2 cells in the plasma display panel 1 is shown in the state where substrate structural bodies 10 and 20 are separated so that inner structure can be seen well.

The plasma display panel 1 includes a pair of substrate structural bodies 10 and 20. The substrate structural body means a structural body including a glass substrate having dimensions larger than the screen and at least one type of other panel element. The substrate structural body 10 on the front side includes a glass substrate 11, the display electrodes X and Y, a dielectric layer 17 and a protection film 18. The display electrodes X and Y are covered with the dielectric layer 17 and the protection film 18. The substrate structural body 20 on the back side includes a glass substrate 21, the address electrodes A, an insulator layer 24, a partition 29 that is a mesh pattern discharge barrier and fluorescent material layers 28R, 28G and 28B. The partition 29 is a structural body in which a plurality of vertical walls 291 for dividing the screen into columns and a plurality of horizontal walls 292 for dividing the screen into rows are integrated. An intersection of the vertical wall 291 and the horizontal wall 292 of the partition 29 is a common portion shared by the vertical wall 291 and the horizontal wall 292. The fluorescent material layers 28R, 28G and 28B are excited by ultraviolet rays emitted by a discharge gas to emit light. The parenthesized alphabet letters R, G and B in FIG. 2 represent light emission colors of the fluorescent materials.

Structure of the Electrode

Figure 3:
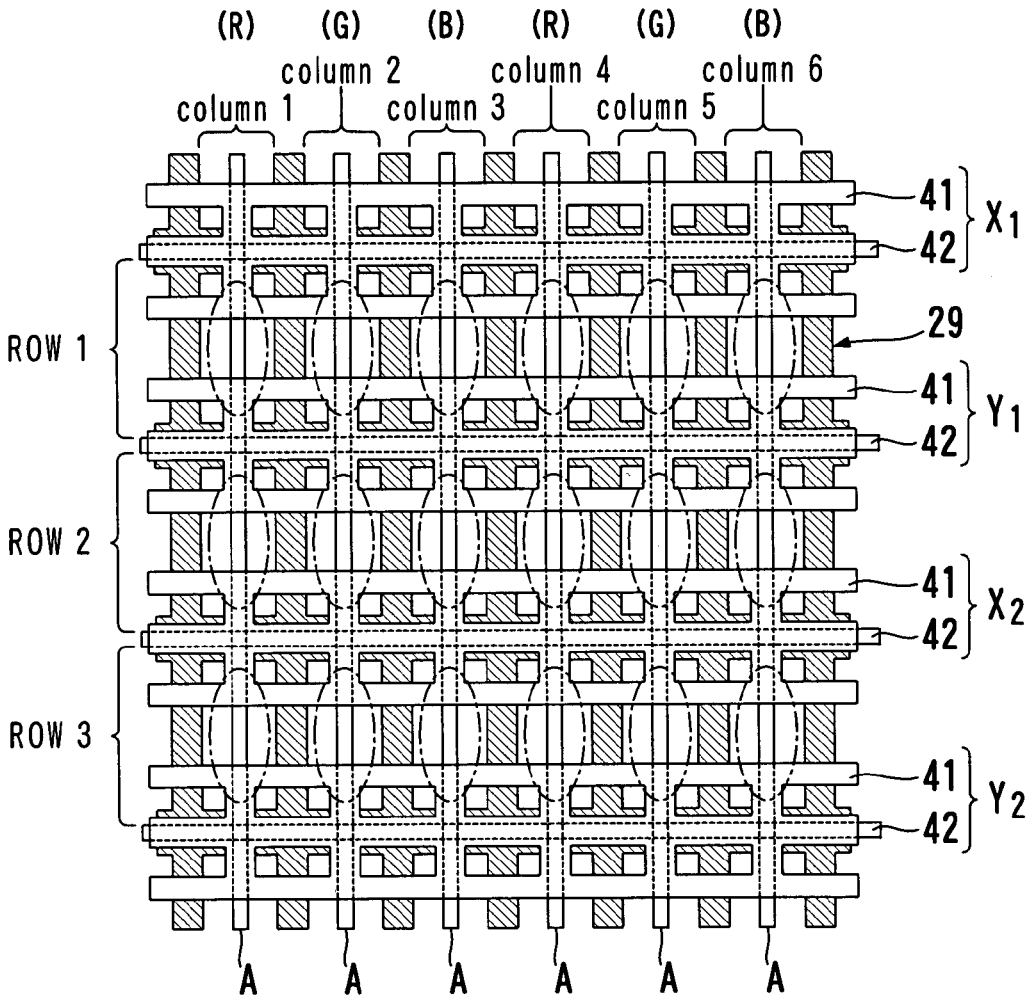
FIG. 3 is a schematic diagram of an electrode arrangement.

FIG. 3 is a schematic diagram of an electrode arrangement. In FIG. 3, a matrix of three rows and four columns is exemplified, and each of cell positions is indicated by an ellipse of an alternate long and short dash line.

Each of the display electrodes $X_1$, $X_2$, $Y_1$ and $Y_2$ includes a thick band-like transparent conductive film 41 for forming a surface discharge gap and a thin band-like metal film 42 that is a bus conductor for reducing resistance. A set of neighboring display electrodes $X_1$ and $Y_1$, $Y_1$ and $X_2$, or $X_2$ and $Y_2$ constitutes an electrode pair (an anode and a cathode)

for surface discharge. The display electrodes $X_1$ and $Y_2$ at ends of the arrangement work for a display of one row, while other display electrodes $X_2$ and $Y_1$ work for displays of neighboring two rows. Namely, the display electrode arrangement is a shared type.

Among the display electrodes $X_1$, $X_2$, $Y_1$ and $Y_2$, the display electrodes $Y_1$ and $Y_2$ are made scan electrodes for row selection in the addressing. Therefore, a shape that causes little variation of operation conditions among cells is adopted especially for the display electrodes $Y_1$ and $Y_2$. Note that the display electrodes $X_1$ and $X_2$ are made in the same shape as the display electrodes $Y_1$ and $Y_2$ so that plural times of display discharge can be generated stably in the example.

Figure 4A:
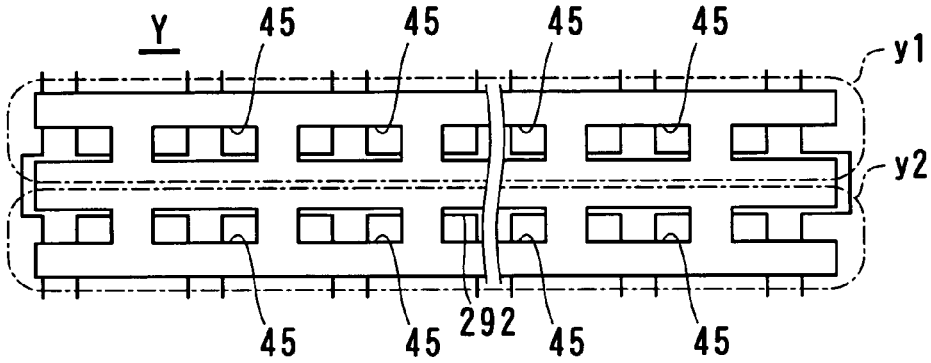
FIGS. 4A-4D are diagrams showing a structure of the display electrode.
Figure 4B:
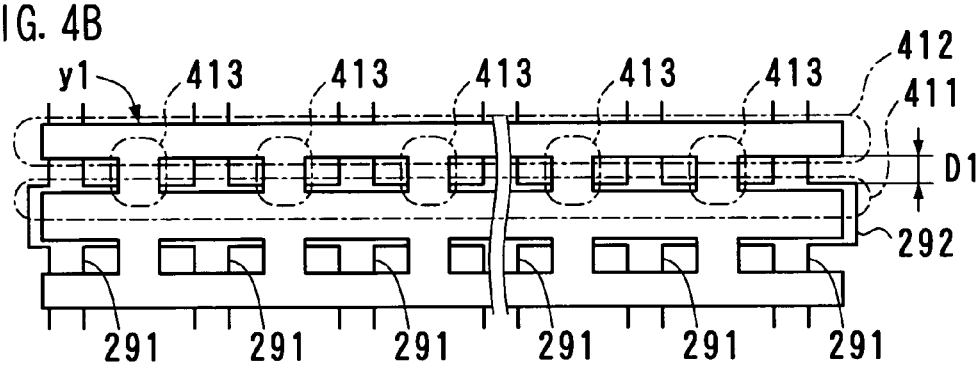
Figure 4C:
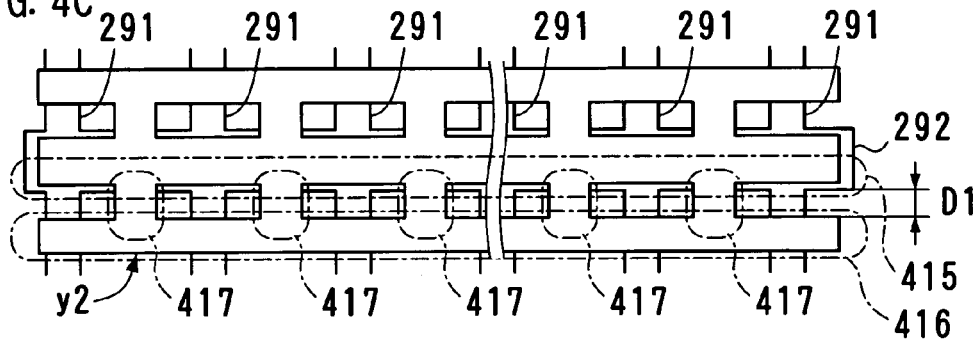
Figure 4D:
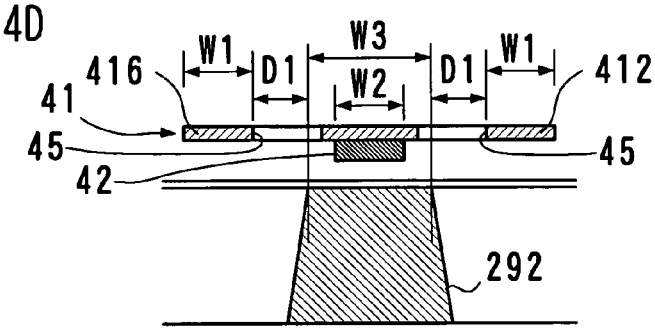

FIGS. 4A-4D are diagrams showing a structure of the display electrode Y. FIGS. 4A-4C are plan views, and FIG. 4D is a cross section. The shape of the display electrode is defined by the transparent conductive film, so the metal film is omitted in FIGS. 4A-4C.

The display electrode Y has a width that is larger than the horizontal wall 292 and is constant over the entire length of the row, and has an axisymmetric band-like shape with plural rectangular holes 45 that are arranged at a constant pitch along the horizontal wall 292 at both sides of a portion overlapping with the horizontal wall 292 as shown in FIG. 4A. Each of the holes 45 has dimensions overlapping with the horizontal wall 292 partially. Each of two parts y1 and y2 that are obtained by dividing the display electrode Y into two in the column direction works for a display of one row. The shape of the electrode will be described in more detail.

As shown in FIG. 4B, one part y1 has a ladder-like shape and includes a first horizontal band pattern 411 extending over cells of one row at a position that overlaps the horizontal wall 292, a second horizontal band pattern 412 extending over cells of one row at a position that does not overlap the horizontal wall 292 and a plurality of vertical band patterns 413 that link the first horizontal band pattern 411 with the second horizontal band pattern 412 at a position that does not overlap the vertical wall 291. A gap between the horizontal band patterns that are separated by the vertical band pattern 413 is the above-mentioned hole 45. In the same way, the other remained part y2 also has a ladder-like shape as shown in FIG. 4C and includes a first horizontal band pattern 415 extending over cells of one row at a position that overlaps the horizontal wall 292, a second horizontal band pattern 416 extending over cells of one row at a position that does not overlap the horizontal wall 292 and a plurality of vertical band patterns 417 that link the first horizontal band pattern 415 with the second horizontal band pattern 416 at a position that does not overlap the vertical wall 291. The vertical band patterns 413 and 417 are disposed at the middle of a gap between the vertical walls 291 so that one of them corresponds to one gap. Shapes of electrodes of cells are the same as each other.

Because of the holes 45 that are provided in the display electrode Y, even if positions of the display electrode Y and the horizontal wall 292 are shifted in the vertical direction from each other in manufacturing process of the plasma display panel 1, increased or decreased quantity of electrode area in each cell is smaller than the case where the holes 45 are not formed. If a position of the display electrode Y is inclined with respect to the horizontal wall 292, increased or decreased quantity of the electrode area may vary among cells in the row, but the difference is very little compared with the case where the holes 45 are not formed. Because the vertical band patterns 413 and 417 are located at the middle of a gap between the vertical walls 291, even if positions of the display electrode Y and the horizontal wall 292 are shifted in the horizontal direction from each other, the electrode area of each cell does not change. Moreover, because the horizontal band patterns 412 and 416 extend over cells of one row, even if the positions of the display electrode Y and the horizontal wall 292 are shifted in the vertical direction, variation of discharge characteristics that depend on a positional relationship between the electrode and the partition is little compared with the case where the horizontal band patterns 412 and 416 are separated for each cell (for example, an electrode that is patterned in a T-shape).

The width W1 of the horizontal band patterns 412 and 416 shown in FIG. 4D and the distance D1 in a plan view between the horizontal band pattern 412 or 416 and the upper face of the horizontal wall 292 should be selected appropriately in accordance with a cell size. A concrete example will be described later. In addition, in order to prevent operational conditions of two rows from being unequal due to position shift of the display electrode Y, it is preferable to set the width W2 of the metal film 42 to a smaller value than the width W3 of the top of the horizontal wall 292. Considering accuracy of registration, it is preferable that the difference between the width W2 and the width W3 be 20 μm or more.

Figure 5:
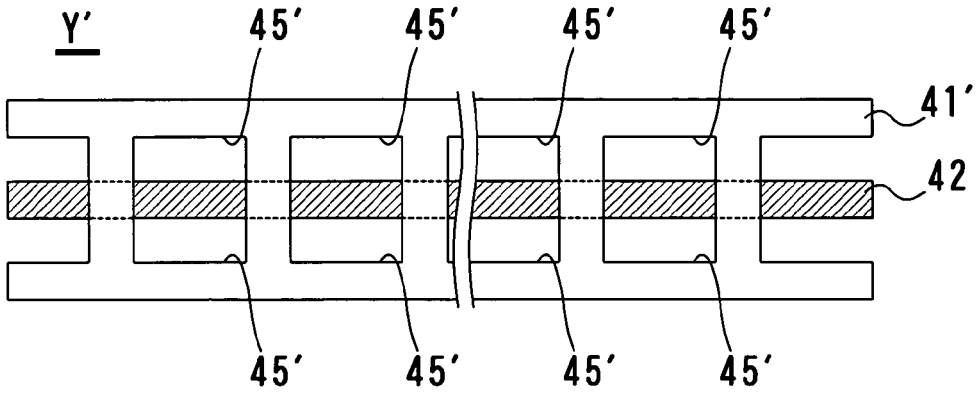
FIG. 5 is a diagram showing a variation of the structure of the display electrode.

FIG. 5 is a diagram showing a variation of the structure of the display electrode. A display electrode Y' includes a transparent conductive film 41' whose general shape is a ladder-like shape and a thin band-like metal film 42 that is overlaid with the transparent conductive film 41' at the middle portion in the width direction. A shape of the display electrode Y' is the same as the shape of the display electrode Y shown in FIG. 4A, which is axisymmetric band-like shape with plural rectangular holes 45' that are arranged at a constant pitch along the metal film 42.

Driving Method

Next, a driving method of the plasma display panel 1 of the plasma display device 100 will be described. The plasma display panel 1 is driven by the driving method for a progressive display that is described in Japanese unexamined patent publication No. 2003-5699.

Figure 6:
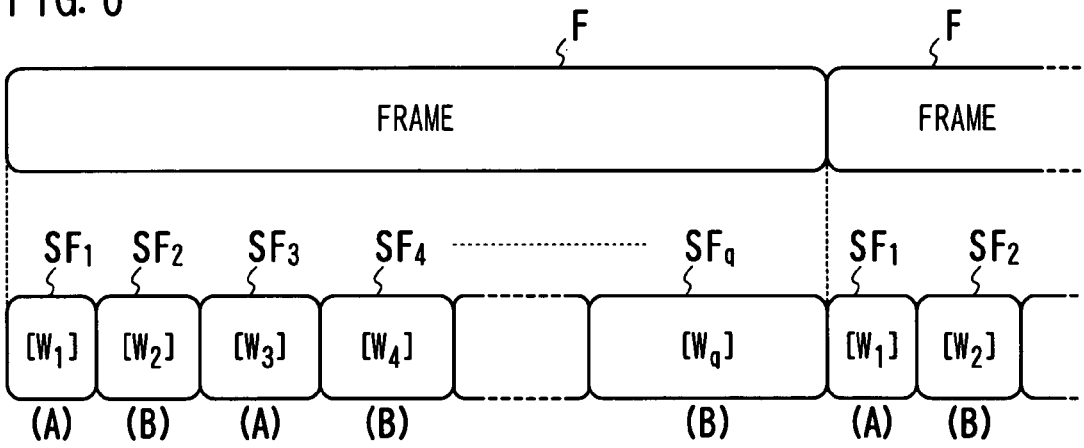
FIG. 6 is a conceptual diagram about a frame division.

FIG. 6 is a conceptual diagram about a frame division. A sequential frame F that is an input image is replaced with q subframes $SF_1$, $SF_2$, $SF_3$, $SF_4$, . . . and $SF_q$ (hereinafter the suffix indicating a display order is omitted) with luminance weights. Each of the luminance weights $\{W_1, W_2, W_3, W_4, \ldots \text{ and } W_q\}$ defines the number of display discharge times. The subframe arrangement may be an order of the weights or other order. However, two address orders are adopted alternately for q subframes SF. Here, the subframe for which one address order is adopted is defined as "subframe A", while the subframe for which the other address order is adopted is defined as "subframe B". In this example, the number of subframes q is an even number, the subframe having an odd display order in each frame F is the "subframe A", and the subframe having an even display order is the "subframe B". The alphabet letters A and B in FIG. 6 indicate this difference.

Figure 7:
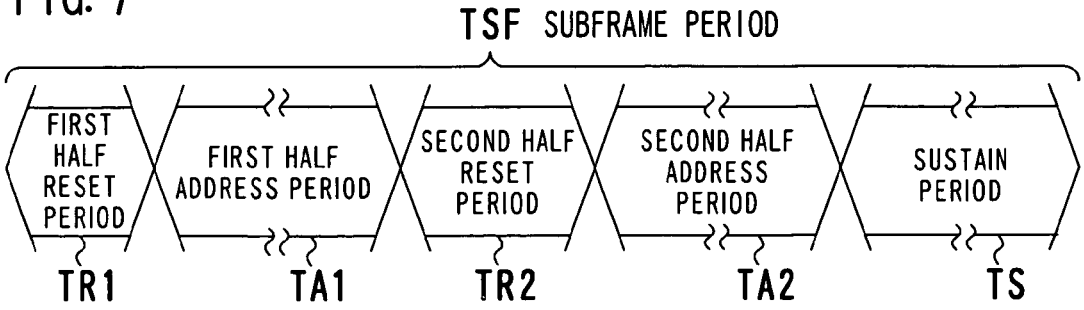
FIG. 7 is a diagram showing a breakdown of the subframe period.

FIG. 7 shows a breakdown of the subframe period. The subframe period TSF that is assigned to one subframe is divided into a first half reset period TR1, a first half address period TA1, a second half reset period TR2, a second half address period TA2 and a sustain period TS.

The first half reset period TR1 is a period for charge adjustment of a row that belongs to one of the first and the second groups that will be described later. The first half address period TA1 is a period for addressing a row for which the charge adjustment is finished. The second half reset period TR2 is a period for the charge adjustment of the remained row while keeping address information that is retained by a row for which addressing is finished. Furthermore, the sustain period TS is a period for generating display discharge plural times corresponding to luminance to be displayed in rows of both the first and the second groups.

The row that belongs to the first group is a row on which a display electrode X having an odd arrangement order when noting only the display electrodes X among the row electrodes (hereinafter this is called a display electrode Xodd) is arranged. The row that belongs to the second group is a row on which a display electrode X having an even arrangement order (hereinafter this is called a display electrode Xeven) is arranged. The charge adjustment is a step for applying a voltage between electrodes that has a waveform in which an instantaneous value increases mildly, and thus generating wall voltage corresponding to a difference between the applied voltage and the discharge start voltage. The charge adjustment is one type of a so-called reset step for equalizing wall charge in cells to be addressed as a preparation step of the addressing step. The addressing step is a step for increasing wall voltage of cells (an absolute value) to be energized higher than wall voltage of cells not to be energized in accordance with the display data during the sustain period TS.

Figure 8:
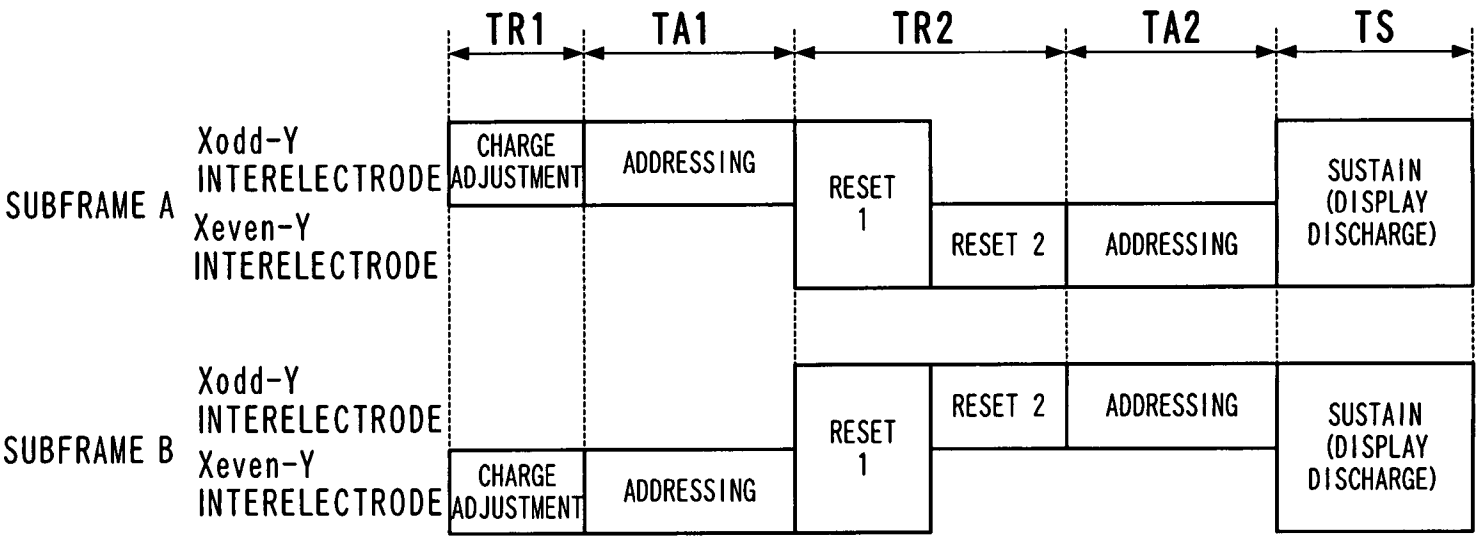
FIG. 8 is a driving sequence diagram.
Figure 9:
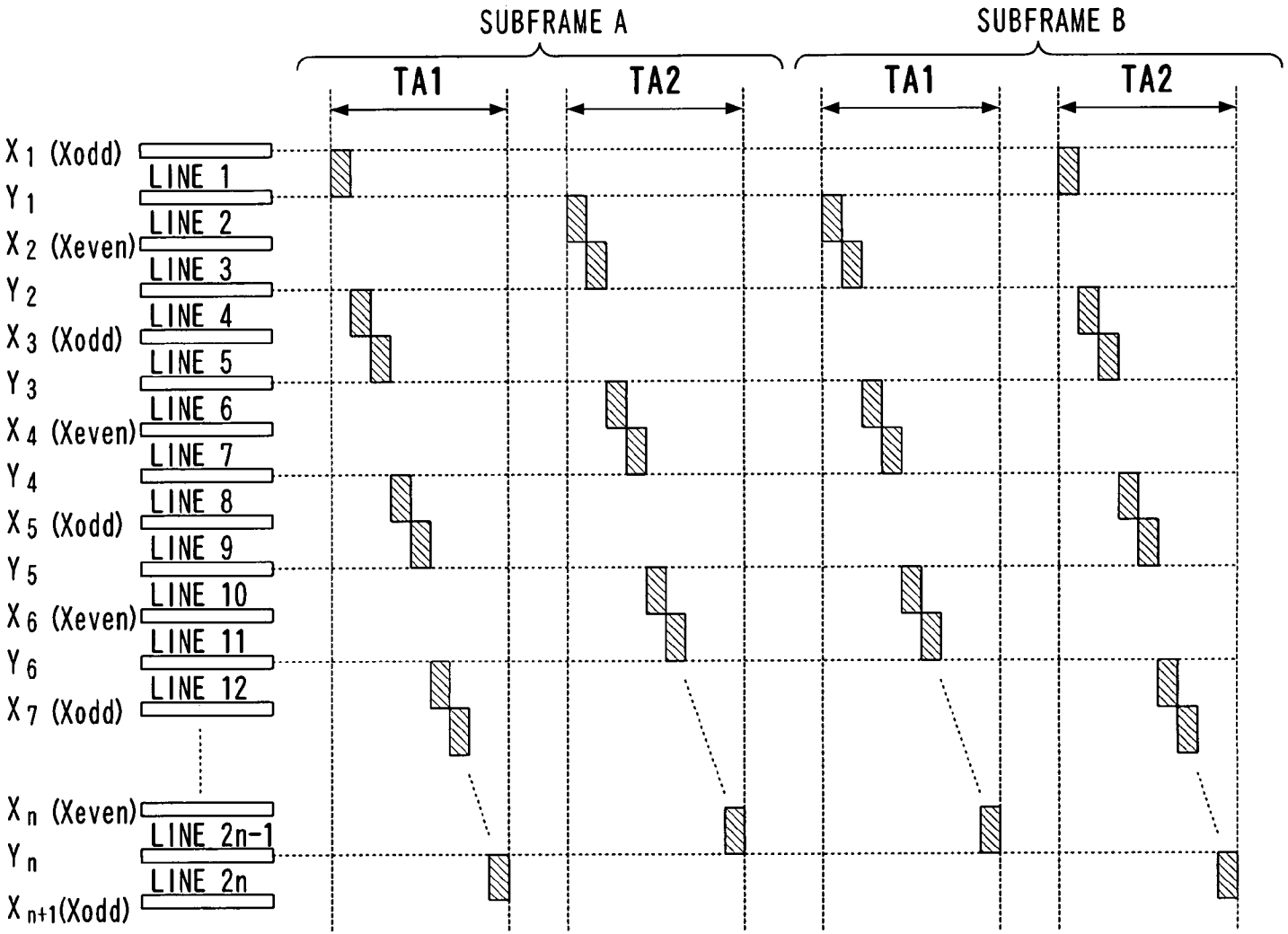
FIG. 9 is a diagram showing an order of row selection in the addressing step.

FIG. 8 is a driving sequence diagram, and FIG. 9 is a diagram showing an order of row selection in the addressing step. In the subframe A, the addressing step is performed for rows of the first group (LINE 1, 4, 5, 8, 9 . . . and 2*n*), and after that the addressing step is performed for rows of the second group (LINE 2, 3, 6, 7, 10, 11, . . . and 2*n* −1). In contrast, in the subframe B, the addressing step is performed for rows of the second group, and after that the addressing step is performed for rows of the first group. In this way, it is not necessary to equalize charge of all cells before the charge adjustment in the first reset period TR1 in the case where the address order is switched for each subframe. Omission of the equalization step shortens a time necessary for addressing preparation step. However, the switching of the address order is not essential for realizing a progressive display. It is possible to perform the addressing step in the same order for all subframes without classifying the subframe A and the subframe B.

Note that reset 1 is a step for erasing charge of cells that were not discharged in the first half addressing so that they will not respond in the second half addressing, while reset 2 is a step in which forming predetermined charge and subsequent charge adjustment are combined, both of which are performed in the second half reset period TR2 in the sequence shown in FIG. 8.

Figure 10:
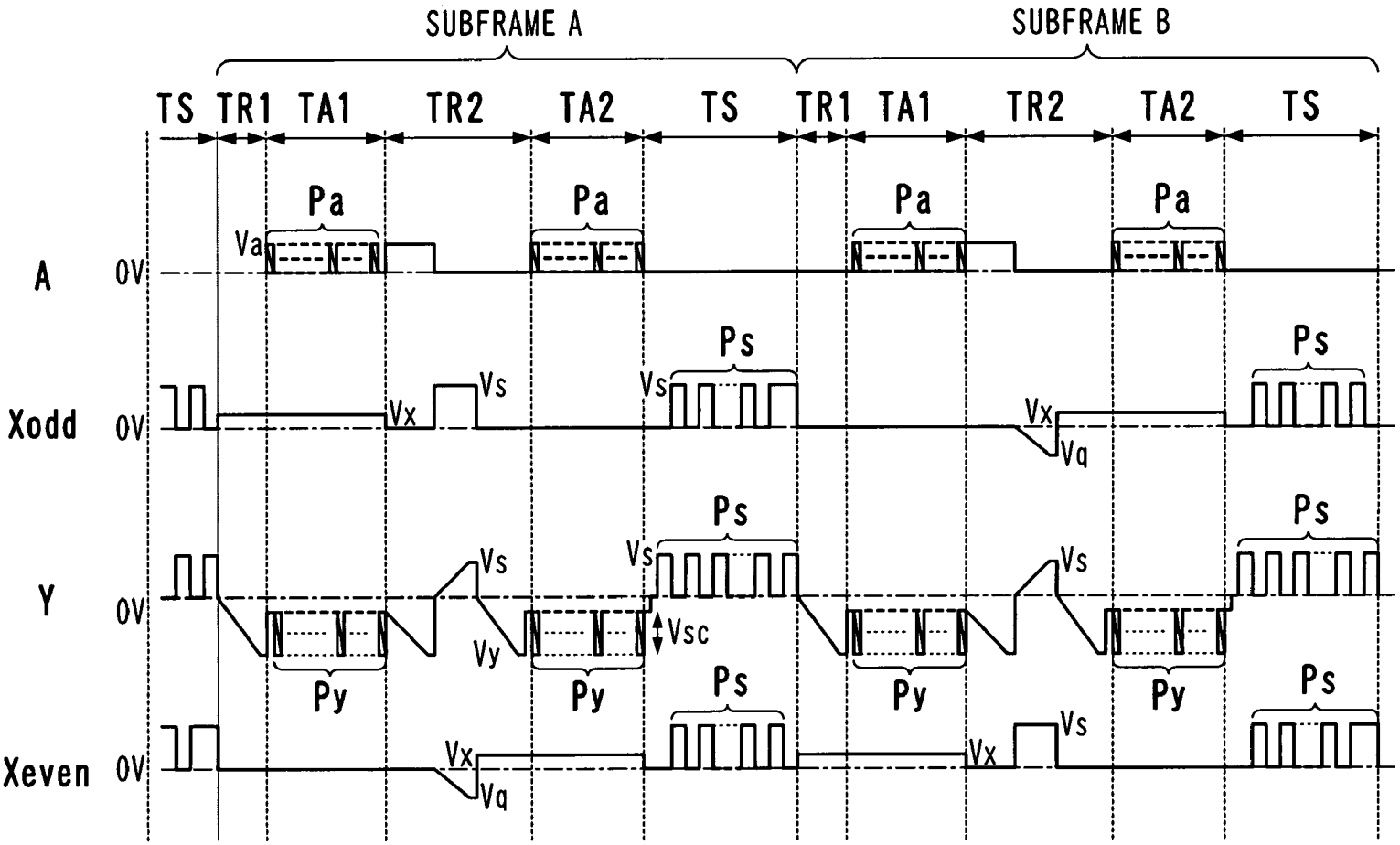
FIG. 10 is a diagram showing an example of a drive voltage waveform.

FIG. 10 is a diagram showing an example of a drive voltage waveform.

In the first half reset period TR1, the display electrode X of the target row (Xodd or Xeven) is biased to potential Vx, and a ramp waveform pulse is applied to the display electrode Y. Three steps of driving are performed in the second half reset period TR2. In the first step, the address electrode A is biased, and the ramp waveform pulse is applied to the display electrode Y. In the second step, a ramp waveform pulse having terminus potential Vq is applied to the display electrode X of the target row (Xeven or Xodd), a rectangular pulse having amplitude Vs is applied to remained display electrode X (Xodd or Xeven), and a ramp waveform pulse having a terminus potential Vs is applied to the display electrode Y simultaneously.

When performing the addressing in the first half address period TA1 and the second half address period TA2, the display electrode X of the target row (Xodd or Xeven) is biased to potential Vx, and a scan pulse Py is applied to the display electrode Y of the target row sequentially. In synchronization with the row selection by applying the scan pulse Py, an address pulse Pa having amplitude Va is applied to the address electrode A defined by the display data. The address discharge is generated in the cell to which both the scan pulse Py and the address pulse Pa are applied. When the addressing is started, the row to be addressed has become in the state where the address discharge can be generated by the charge adjustment that was performed just before that while the row not to be addressed is in the state where the address discharge cannot be generated.

In the sustain period TS, a sustain pulse Ps having amplitude Vs is applied alternately to the display electrode Y and the display electrode X (Xodd and Xeven). Then, surface discharge that is display discharge is generated by each application of the sustain pulse Ps in cells where a predetermined quantity of wall charge was formed in the previous addressing.

A typical example of main voltages in the waveforms shown in FIG. 10 will be described below.

Vq=−140 volts, Vx=90 volts, Vs=170 volts, Vy=−170 volts, Vsc=120 volts and Va=70 volts.

In the above driving sequence, charge quantity of the cell to be energized in which charge was formed during the first half addressing should be kept until the sustain period TS. However, in order to perform the charge adjustment as a preparation of the second half addressing, a voltage that is high to some extent should be applied to the display electrode Y. Charge of the positive polarity is accumulated in the vicinity of the display electrode Y of the cell to be energized during the first half addressing period. Therefore, if the accumulated quantity is excessive, misdischarge will be generated in a cell having excessive charge when the voltage of the positive polarity is applied to the display electrode Y after the first half addressing, and as a result display discharge may not be generated. Therefore, it is important to control the accumulated quantity of charge appropriately. The display electrode Y having the above-mentioned shape can achieve an effect of reducing variation of operation conditions among cells, so it is suitable for a progressive display using the above-mentioned driving sequence.

Dimensional Condition of the Display Electrode

Figure 11:
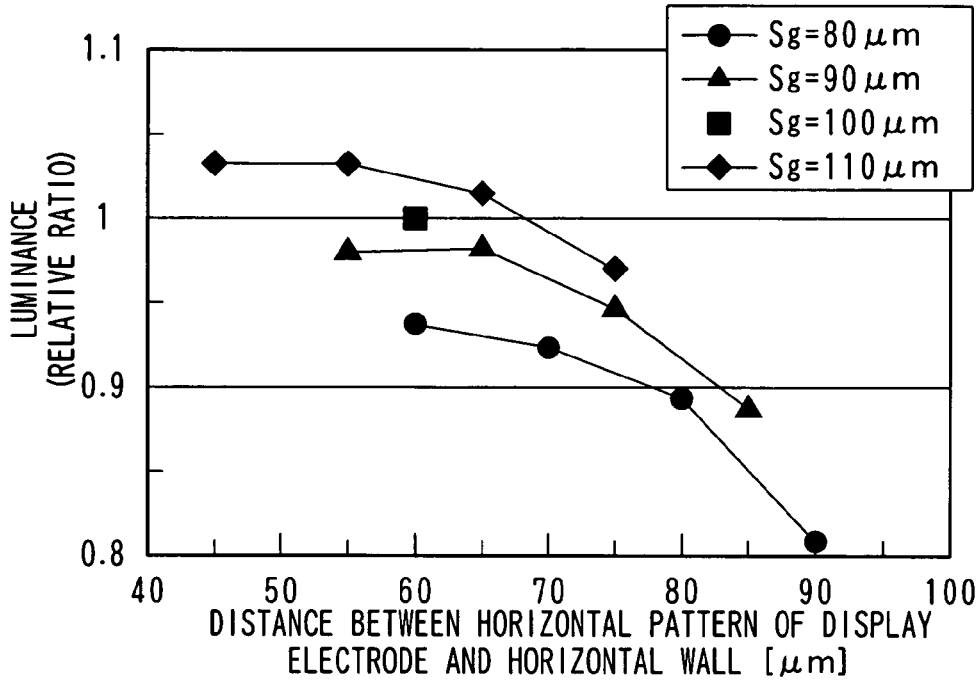
FIG. 11 is a diagram showing a relationship between a pattern size of the display electrode and luminance.
Figure 12:
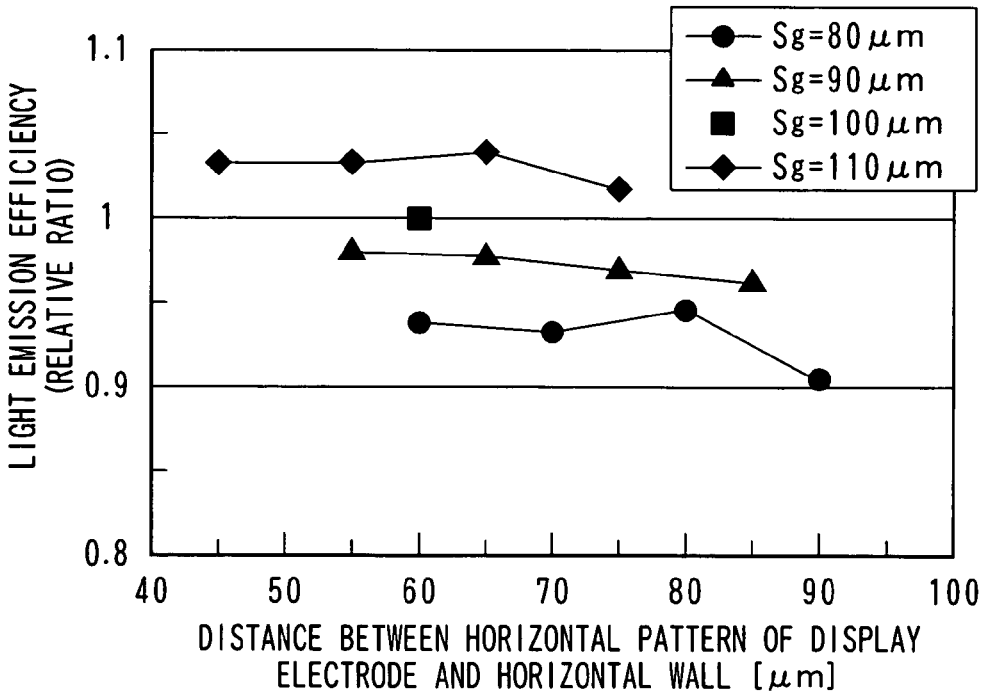
FIG. 12 is a diagram showing a relationship between a pattern size of the display electrode and light emission efficiency.

FIGS. 11 and 12 show results of dependency of luminance and light emission efficiency respectively on a distance in a plan view when making a plurality of plasma display panels having a screen of 42 inch and different pattern sizes of the display electrode and studying the dependency with a parameter of the surface discharge gap length (a distance between display electrodes) Sg. The distance in a plan view is the distance D1 between the horizontal band pattern 412 or 416 and the upper face of the horizontal wall 292 as shown in FIGS. 4B-4D. It is understood from FIG. 11 that when the distance D1 exceeds 80 μm, the drop of luminance becomes conspicuous. In addition, as shown in FIG. 12, the light emission efficiency decreases as the distance D1 increases. However, the smaller the distance D1 is, the larger the influence of the misregistration upon manufacturing to the electrode area of the cell. From the viewpoint of reliability of driving, it is better that the distance D1 is large. Considering accuracy of registration upon mass production, it is necessary to set the distance D1 to 30 μm or more. From the above description, it is desirable to set the distance D1 to a value within the range of 30 80 μm.

Variation of the Electrode

Figure 13A:
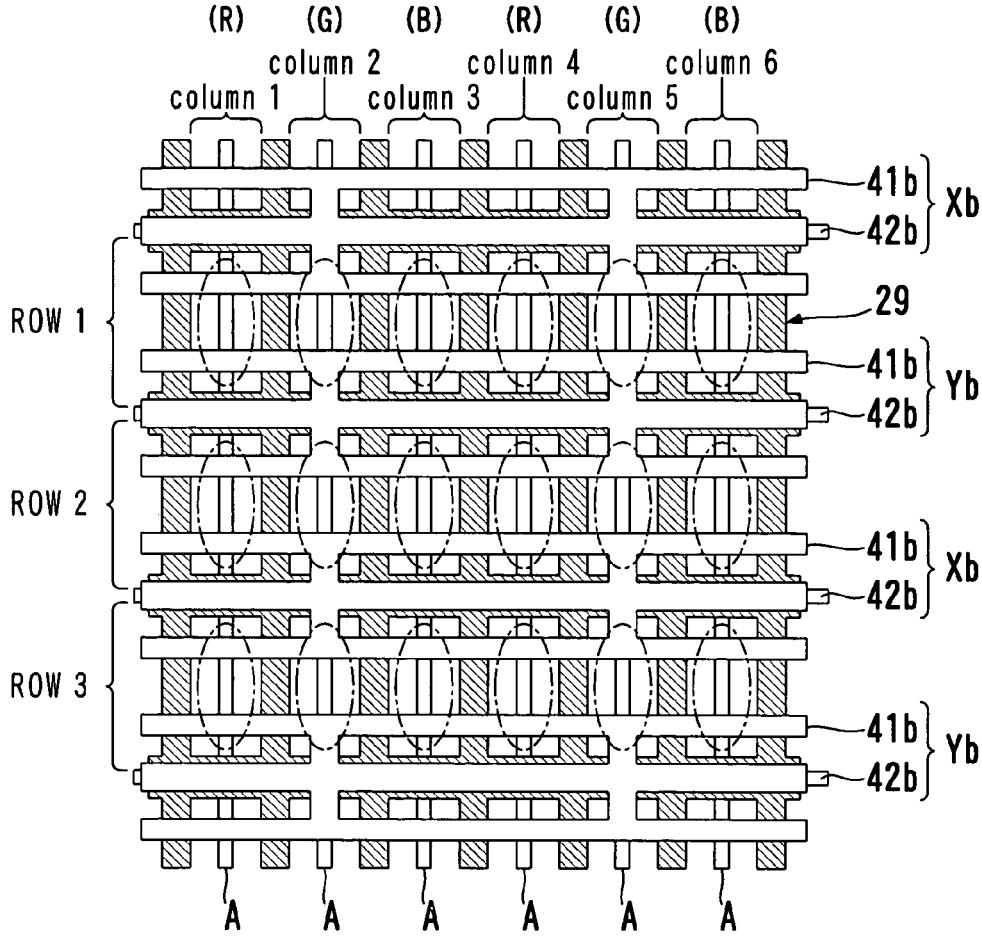
FIGS. 13A and 13B show a variation of a shape of the display electrode.
Figure 13B:
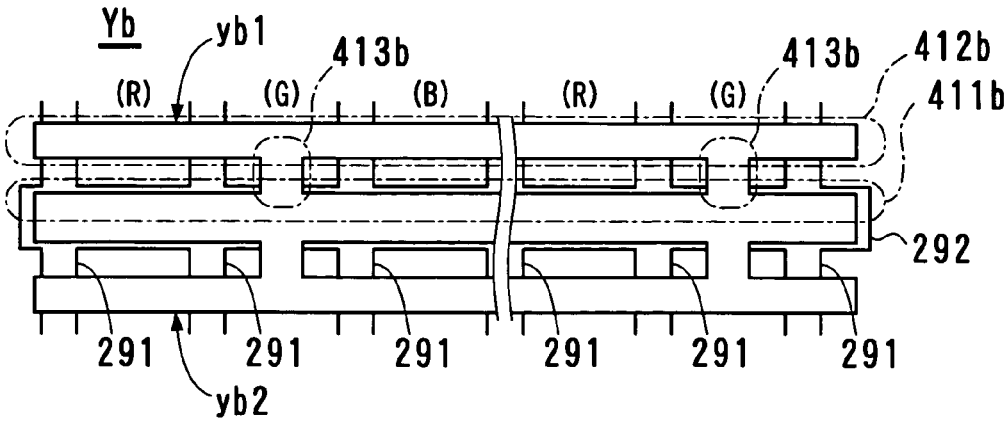

FIGS. 13A and 13B show a variation of a shape of the display electrode. FIG. 13A is a schematic diagram of an electrode arrangement and shows a matrix of three rows and four columns similarly to FIG. 3. Positions of cells are indicated by ellipses in alternate long and short dash lines. FIG. 13B is an enlarged view of the main portion of the display electrode, in which metal films are omitted.

Each of the display electrodes Xb and Yb includes a thick band-like transparent conductive film 41*b* that forms a surface discharge gap and a thin band-like metal film 42*b* that is a bus conductor for reducing resistance. The shape of the display electrode Xb is the same as the shape of the display electrode Yb. Here, the display electrode Yb is noted for describing the shape.

As shown in FIG. 13B, the display electrode Yb is formed in an axisymmetric band-like shape that has a width that is larger than the horizontal wall 292 and has plural rectangular holes arranged at a constant pitch along the horizontal wall 292 at both sides of a portion overlapping with the horizontal wall 292. The display electrode Yb is divided into two ladder-like portions yb1 and yb2 in the column direction, each of which works for a display of one row. One portion yb1 includes a first horizontal band pattern 411*b* extending over cells of one row at a position that overlaps the horizontal wall 292, a second horizontal band pattern 412*b* extending over cells of one row at a position that does not overlap the horizontal wall 292 and a plurality of vertical band pattern 413*b* that link the first horizontal band patterns 411*b* with the second horizontal band pattern 412*b* at a position that does not overlap the vertical wall 291. The other remained portion yb2 is similar to the portion yb1. The shape of the display electrode Yb is also advantageous to reduce influence of misregistration of the substrate pair in the same way as the shape shown in FIG. 3. The less the number of the vertical band patterns 413*b* is, the less the influence of the misregistration is. However, the vertical band pattern 413*b* cannot be eliminated for securing conductivity.

A characteristic of the display electrode Yb is that the vertical band pattern 413*b* is arranged only in specific cells. More specifically, the vertical band pattern 413*b* is arranged only in cells whose light emission color is green (G), while in cells whose light emission color is red (R) or blue (B) the horizontal band pattern 411*b* is separated completely from the horizontal band pattern 412*b*. The cells of red or blue light emission color are provided with discharge current from the metal film 42*b* via the vertical band pattern 413*b* of the green cell.

The cell having the vertical band pattern 413*b* has a wider discharge area and higher luminance than other cells. When arranging the vertical band pattern 413*b* in one of RGB three color cells, it is the best to arrange in a G cell that has the largest relative luminous efficiency for obtaining higher luminance.

On the other hand, the discharge start voltage for discharge between the display electrode Yb and the address electrode A depends on a material of the fluorescent material. In general, the discharge start voltage depends on the light emission color. The discharge start voltage Vfn when generating address discharge in all cells was measured by using a plasma display panel in which electrodes are arranged uniformly in all cells, $(Y,Gd)BO_3:Eu^{3+}$ is used for a red fluorescent material, $Zn_2SiO_4:Mn^{2+}$ is used for a green fluorescent material, and $BaMgAl_{10}O_{17}:Eu^{2+}$ is used as a blue fluorescent material, for example. The result was 175 volts in the red cell, 205 volts in the green cell, and 200 volts in the blue cell.

If the vertical band pattern 413*b* is disposed, the electrode area becomes larger than the case where it is not disposed. Namely, disposing the vertical band pattern 413*b* has an effect of lowering the discharge start voltage Vfn. Therefore, when selecting one or two colors from red, green and blue colors in the descending order of the discharge start voltage Vfn and disposing the vertical band pattern 413*b* only in the selected color cell, the difference of the discharge start voltage Vfn can be reduced so that conditions of the address discharge is equalized. Thus, a margin of setting drive voltage can be expanded.

Figure 14:
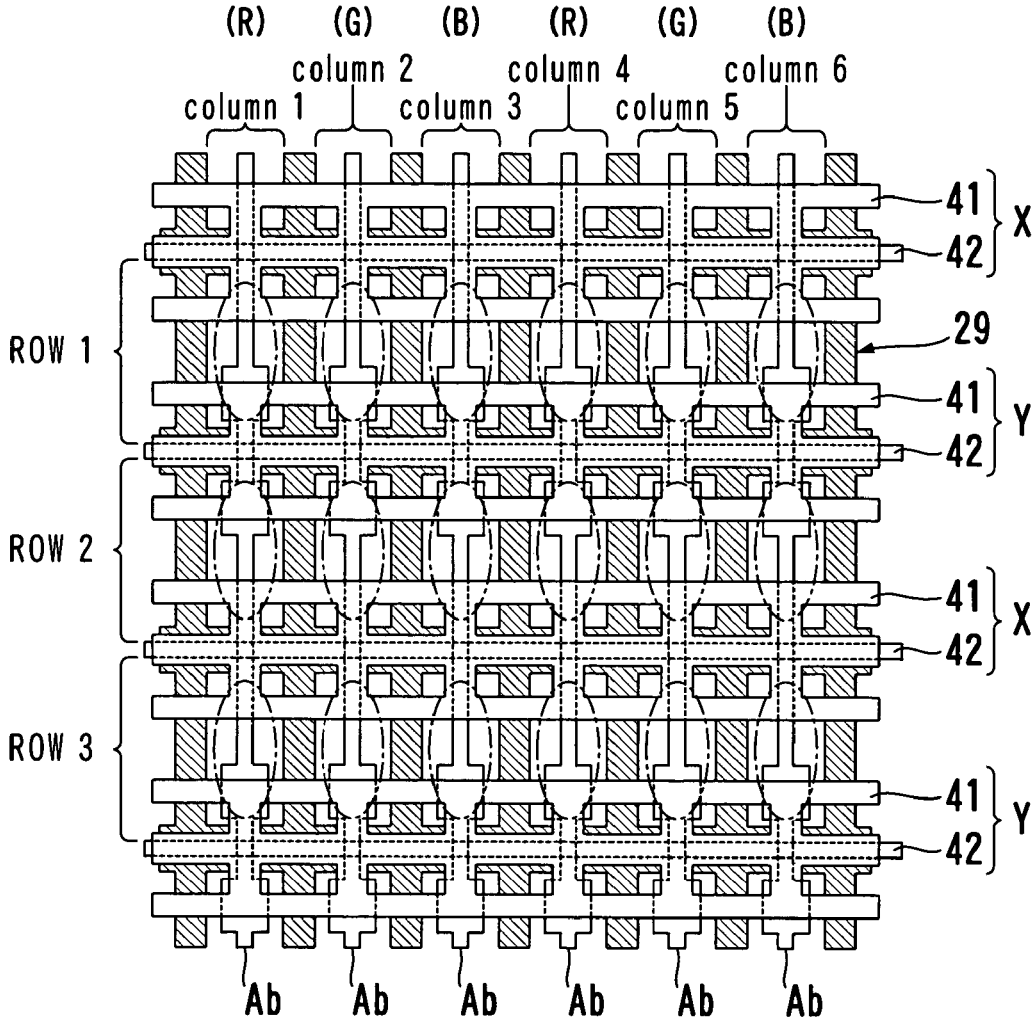
FIG. 14 is a diagram showing a variation of a shape of the address electrode.

FIG. 14 shows a variation of a shape of the address electrode. When a progressive display is controlled by the above-mentioned driving sequence, it is desirable to make the discharge start voltage of the address discharge substantially the same between two neighboring rows that share each display electrode Y. Particularly, in the sequence of switching the addressing order for each subframe, the equalization of the discharge start voltage is important. If there is a difference between the discharge start voltages, excessive charge will be accumulated and misdischarge may be generated by the address discharge in a subframe in which the first half addressing is performed for a row having a low discharge start voltage.

As shown in FIG. 14, the address electrode Ab has a band-like shape in which portions facing the display electrode Y are locally thick. A pad that is a thick portion of the address electrode Ab is disposed at a position that is away from the horizontal wall of the partition 29 and becomes symmetric with the horizontal wall. The position of the pad enables that even the registration of the substrate pair is not correct, the area of the address electrode Ab facing the display electrode Y is almost unchanged. Therefore, a variation in discharge start voltages of cells is not generated.

According to the present invention, a stable progressive display can be realized in a screen that has a shared type arrangement form of display electrodes.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A plasma display device for displaying images in a progressive form, comprising:

a shared electrode type AC plasma display panel; and a progressive drive unit, wherein the plasma display panel comprises:

a screen that is made up of cells arranged in a matrix of rows and columns, a discharge barrier that is made up of vertical walls for dividing the screen into the columns and horizontal walls for dividing the screen into the rows, a plurality of first display electrodes that are arranged along the rows of the cells, each of the first display electrodes being shared by two neighboring rows, a plurality of second display electrodes that are arranged so that the plural first and second display electrodes are arranged with respective electrodes alternating and, each of the second display electrodes functioning as a scan electrode shared by two neighboring rows, and address electrodes that are arranged along the columns, and wherein the progressive drive unit comprises:

a first driver that changes potential of the first display electrode, a second driver that changes potential of the second display electrode as the scan electrode, a third driver that changes potential of the address electrode, and a controller for controlling operations of the first driver, the second driver and the third driver, and wherein a driving sequence defining a control by the controller includes:

(A) addressing for making wall voltage of all cells correspond to display data, being divided into first half addressing and second half addressing, (B) performing charge adjustment for the second half addressing between the first half addressing and the second half addressing, (C) generating display discharge plural times corresponding to luminance to be displayed in all cells to be energized after the second half addressing, and (D) performing one of the first half addressing and the second half addressing for a row on which the first display electrode is arranged that has an odd arrangement order when noting only the first display electrodes and performing the other of the first half addressing and the second half addressing for a row on which the first display electrode is arranged that has an even arrangement order, and wherein each of the second display electrodes as the scan electrodes includes:

a first horizontal band pattern extending along the horizontal wall at a position that overlaps the horizontal wall, two second horizontal band patterns each of which extends along the row of the cells on both sides of the horizontal wall, and a plurality of vertical band patterns that link the first horizontal band pattern with the second horizontal band patterns on the both sides of the first horizontal band pattern at a position that does not overlap the vertical wall, and a metal bus electrode disposed at a part of the first horizontal band pattern that overlaps the horizontal wall, the metal bus electrode having a width smaller than a top width of the horizontal wall by 20 μm or more, and wherein each of the second display electrodes includes a distance in a plan view between the horizontal wall at an arrangement position overlapping the second display electrode and the second horizontal band pattern of the second display electrode falls within the range of 30-80 μm.

2. A plasma display device for displaying images in a progressive form, comprising a shared electrode type AC plasma display panel and a progressive drive unit, wherein the plasma display panel includes:

a screen that is made up of cells arranged in a matrix of rows and columns, a discharge barrier that is made up of vertical walls for dividing the screen into the columns and horizontal walls for dividing the screen into the rows, a plurality of first display electrodes that are arranged along the rows of the cells, each of the first display electrodes being shared by two neighboring rows, a plurality of second display electrodes that are arranged so that the plural first and second display electrodes are arranged with respective electrodes alternating and, each of the second display electrodes functioning as a scan electrode shared by two neighboring rows, address electrodes that are arranged along the columns, and red, green and blue fluorescent materials regularly arranged for each of the columns, and wherein the progressive drive unit includes:

a first driver that changes potential of the first display electrode, a second driver that changes potential of the second display electrode as the scan electrode, a third driver that changes potential of the address electrode, and a controller for controlling operations of the first driver, the second driver and the third driver, and a driving sequence defining a control by the controller includes:

(A) addressing for making wall voltage of all cells correspond to display data, being divided into first half addressing and second half addressing, (B) performing charge adjustment for the second half addressing between the first half addressing and the second half addressing, (C) generating display discharge plural times corresponding to luminance to be displayed in all cells to be energized after the second half addressing, and (D) performing one of the first half addressing and the second half addressing for a row on which the first display electrode is arranged that has an odd arrangement order when noting only the first display electrodes and performing the other of the first half addressing and the second half addressing for a row on which the first display electrode is arranged that has an even arrangement order, and wherein each of the second display electrodes as the scan electrodes includes:

a first horizontal band pattern extending along the horizontal wall at a position that overlaps the horizontal wall, two second horizontal band patterns each of which extends along the row of the cells on both sides of the horizontal wall, and a plurality of vertical band patterns that link the first horizontal band pattern with the second horizontal band patterns on the both sides of the first horizontal band pattern at a position that does not overlap the vertical wall, the vertical band pattern being disposed only at columns including cells having one or two colors selected from among the three colors, so that a difference in discharge characteristics among the fluorescent materials having the three colors is compensated.

3. The plasma display device according to claim 2, wherein the vertical band pattern is disposed only at columns including cells of one or two types having at least one of the green fluorescent material and the blue fluorescent material.

4. The plasma display device according to claim 2, wherein the vertical band pattern is disposed only at columns including cells of two types having the green fluorescent material and the blue fluorescent material.

5. The plasma display device according to claim 2, wherein the vertical band pattern is disposed only at columns including cells having the green fluorescent material.

6. The plasma display device according to claim 1 or 2, wherein:

each of the second display electrodes has an axisymmetric pattern with respect to an axis of every other horizontal wall, and each of the address electrodes is formed axisymmetrically with respect to the axis to have a shape in which a width of a portion facing the second display electrode is larger than a width of a portion facing the first display electrode.

* * * * *